US007817099B2

(12) United States Patent
Wu et al.

(10) Patent No.: US 7,817,099 B2
(45) Date of Patent: Oct. 19, 2010

(54) BROADBAND BALLISTIC RESISTANT RADOME

(75) Inventors: Kuang-Yuh Wu, Plano, TX (US); Ronald J. Richardson, McKinney, TX (US)

(73) Assignee: Raytheon Company, Waltham, MA (US)

( * ) Notice: Subject to any disclaimer, the term of this patent is extended or adjusted under 35 U.S.C. 154(b) by 259 days.

(21) Appl. No.: 11/297,999

(22) Filed: Dec. 8, 2005

(65) Prior Publication Data

US 2008/0136731 A1 Jun. 12, 2008

(51) Int. Cl.
*H01Q 1/42* (2006.01)

(52) U.S. Cl. ..... 343/872

(58) Field of Classification Search ..... 343/872, 343/705, 873, 909

See application file for complete search history.

(56) References Cited

U.S. PATENT DOCUMENTS 3,780,374 A 12/1973 Shibano et al. ..... 343/872
4,358,772 A * 11/1982 Leggett ..... 343/872
4,613,540 A * 9/1986 Traut et al. ..... 428/212
4,868,040 A 9/1989 Hallal et al.
5,182,155 A * 1/1993 Roe ..... 428/116
5,408,244 A * 4/1995 Mackenzie ..... 343/872
7,688,278 B2 * 3/2010 Frenkel ..... 343/872
2004/0227687 A1 * 11/2004 Delgado et al. ..... 343/872
2004/0246195 A1 * 12/2004 Usami et al. ..... 343/872

FOREIGN PATENT DOCUMENTS

DE 11 07 299 B 2/1957
DE 102 57 370 B3 4/2002
WO WO 2006/011133 A1 7/2005

OTHER PUBLICATIONS

PCT Search Report, 06256063.6-2220, 9 pages.
European Patent Office, Communication pursuant to Artile 94(3) EPC, Application No. 06 256 063.6-2220; Ref. No. JL36888P.EPP, 6 pages, Jun. 17, 2009.

* cited by examiner

*Primary Examiner*—Hoang V Nguyen
*Assistant Examiner*—Robert Karacsony
(74) *Attorney, Agent, or Firm*—Baker Botts L.L.P.

(57) ABSTRACT

According to one embodiment of the invention, a radome cover for an RF sensor has been provided. The radome cover comprises a ceramic core and at least two layers. The ceramic core is sandwiched between the at least two layers and the at least two layers are impedance matched to the ceramic core. The radome cover provides ballistic protection for the RF sensor.

23 Claims, 7 Drawing Sheets

BROADBAND BALLISTIC RESISTANT RADOME

GOVERNMENT FUNDING

This invention was made with Government support via Contract DAAE07-03-9-F001 awarded by the United States Army. The Government has certain rights in this invention.

TECHNICAL FIELD OF THE INVENTION

This invention relates generally to the housing of RF sensors and, more particularly, to a broadband ballistic resistant radome.

BACKGROUND OF THE INVENTION

Among RF sensors, Electronic scanned array (ESA) sensors are expensive, hard to replace in a battle field, and essential in a variety of applications. For example, ESA sensors may be used to detect the location of objects or individuals. In detecting the location of such objects or individuals, ESA sensors may utilize a plurality of elements that radiate signals with different phases to produce a beam via constructive or destructive interference. The direction the beam points is dependent upon the differences of the phases of the elements and how the radiation of the elements constructively or destructively force the beam to point in a certain direction. Accordingly, the beam can be steered to a desired direction by simply changing the phases of the elements. Using such steering, the ESA sensors may both transmit and receive signals, thereby detecting the presence of the object or individual.

When ESA sensors are used in combat settings, difficulties can arise. For example, ESA sensors may be exposed to gunfire and fragmentation armaments, which can disable portions of the ESA sensors or render the ESA sensors inoperable.

SUMMARY OF THE INVENTION

Given the above difficulties that can arise, it is desirable to produce a radome cover for an RF sensor housing with acceptable ballistic protection, acceptable power transmission for a desired frequency band, and acceptable scan volume.

According to one embodiment of the invention, a radome cover for an RF sensor has been provided. The radome cover comprises a ceramic core and at least two layers. The ceramic core is sandwiched between the at least two layers and the at least two layers are impedance matched to the ceramic core. The radome cover provides ballistic protection for the RF sensor.

Certain embodiments of the invention may provide numerous technical advantages. For example, a technical advantage of one embodiment may include the capability to provide a radome cover that is substantially transparent to electromagnetic signals while maintaining a capability to dissipate kinetic energy of moving objects, namely ballistics such as bullets and fragmentation armaments. Other technical advantages of other embodiments may include the capability to provide a radome cover that has a low permeation path for water vapor to protect non-hermetic electronics.

Although specific advantages have been enumerated above, various embodiments may include all, some, or none of the enumerated advantages. Additionally, other technical advantages may become readily apparent to one of ordinary skill in the art after review of the following figures and description.

BRIEF DESCRIPTION OF THE DRAWINGS

For a more complete understanding of example embodiments of the present invention and its advantages, reference is now made to the following description, taken in conjunction with the accompanying drawings, in which.

DETAILED DESCRIPTION OF EXAMPLE EMBODIMENTS OF THE INVENTION

It should be understood at the outset that although example embodiments of the present invention are illustrated below, the present invention may be implemented using any number of techniques, whether currently known or in existence. The present invention should in no way be limited to the example embodiments, drawings, and techniques illustrated below, including the embodiments and implementation illustrated and described herein. Additionally, while some embodiments will be described with reference to an electronic scanned array (ESA) RF components, other RF components, including, but not limited to antennas, sensors (including single RF sensors), radiating devices, and others may avail themselves of the teachings of the embodiments of the invention. Further, such ESA and other RF components may operate at any of a variety of frequencies. Furthermore, the drawings are not necessarily drawn to scale.

In combat settings, it may be desirable to utilize electronic scanned array (ESA) sensors to detect a presence of objects or individuals. However, difficulties can arise. The ESA sensors may be exposed to gunfire and fragmentation armaments, which can disable portions of the ESA sensors or render the ESA sensors inoperable. Accordingly, teachings of some embodiments of the invention recognize a radome cover that minimizes transmission loss for electromagnetic signals while providing suitable ballistic protection for electronics transmitting or receiving the electromagnetic signals. Additionally, teachings of other embodiments of the invention recognize a radome cover that provides a low permeation path for water vapor, thereby protecting non-hermetic electronics.

Figure 1:
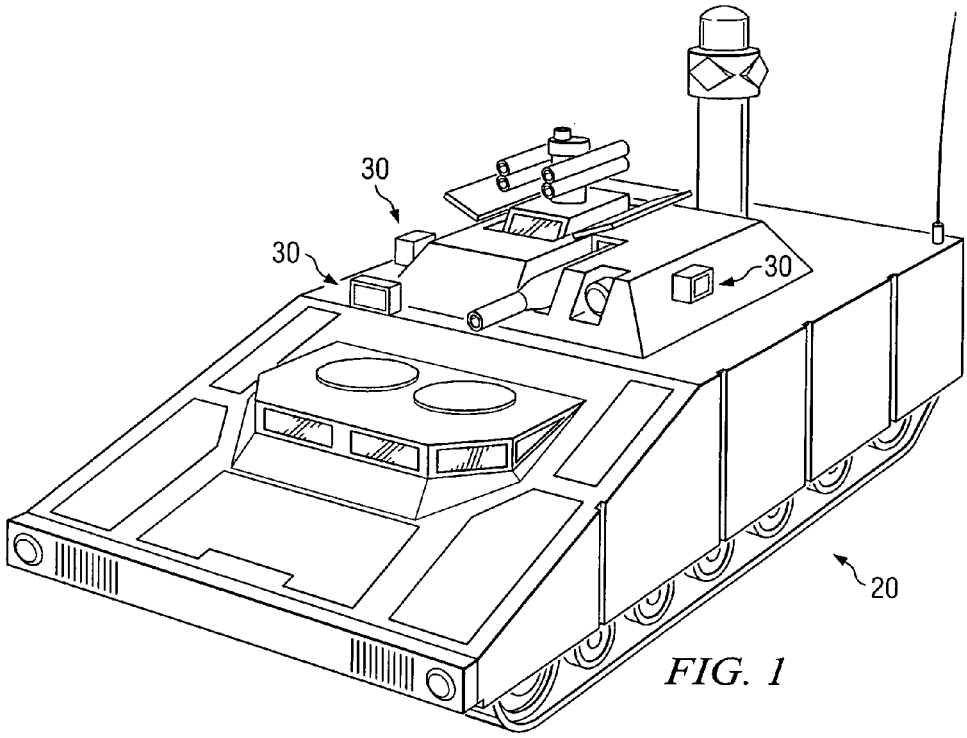
FIG. 1 shows an illustrative environmental view of a plurality of active electronically scanned arrays (AESA) units disposed around an armored vehicle, according to an embodiment of the invention.
Figure 2:
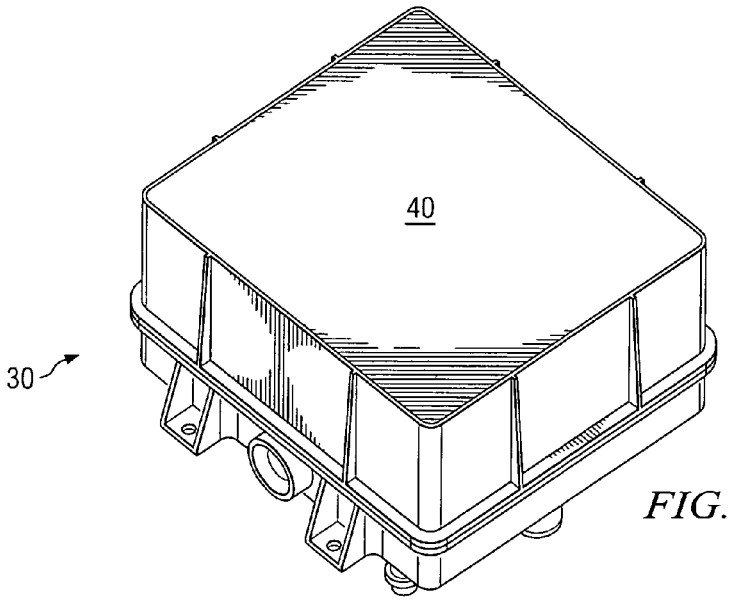
FIG. 2 shows an exploded view of one of the AESA units of FIG. 1.

FIG. 1 shows an illustrative environmental view of a plurality of active electronically scanned arrays (AESA) units 30 disposed around an armored vehicle 20, according to an embodiment of the invention. FIG. 2 shows an exploded view of one of the AESA units 30 of FIG. 1. Upon the armored vehicle 20, the AESA units 30 may be exposed to ballistics (i.e., gunfire or the like) or fragmentation armaments. Accordingly, the AESA units 30 may be constructed of a variety of materials to protect the electronics within the AESA units 30. To allow electromagnetic radiation to propagate though a portion of the AESA unit 30, one side of the AESA unit 30 includes a radome cover 40 disposed over an aperture or window 32 (seen in FIG. 3). Further details of the radome cover 40 are described in greater detail below. The remainder of AESA unit 30 may be protected with any suitable material (e.g., metal, ceramics, or the like) to resist ballistics (i.e., gunfire or the like) or fragmentation armaments. In particular embodiments, the AESA unit 30 may be transmitting or receiving in the Ka frequency band. In other embodiments, the AESA unit 30 may be transmitting or receiving in other frequency bands. Accordingly, it should be expressly understood that embodiments may utilize any suitable RF frequency band.

Figure 3:
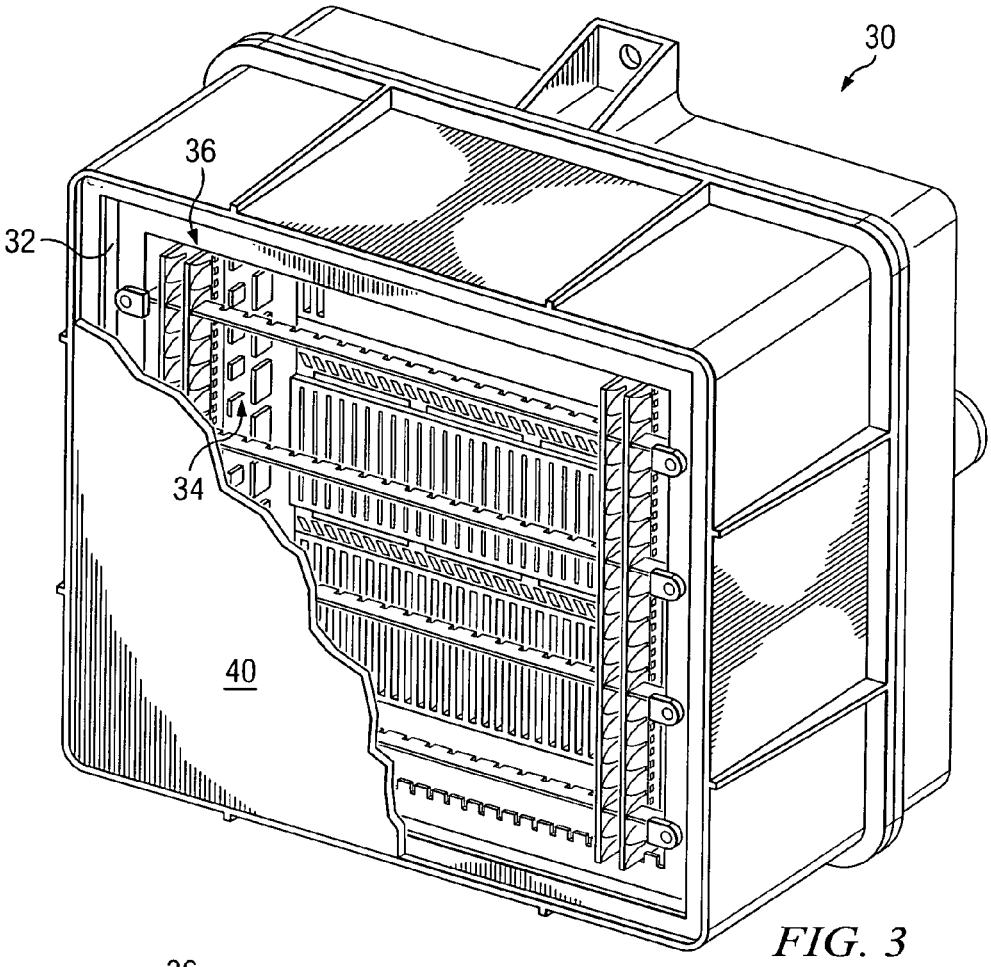
FIGS. 3 and 4 illustrates further details of an AESA unit, according to an embodiment of the invention.
Figure 4:
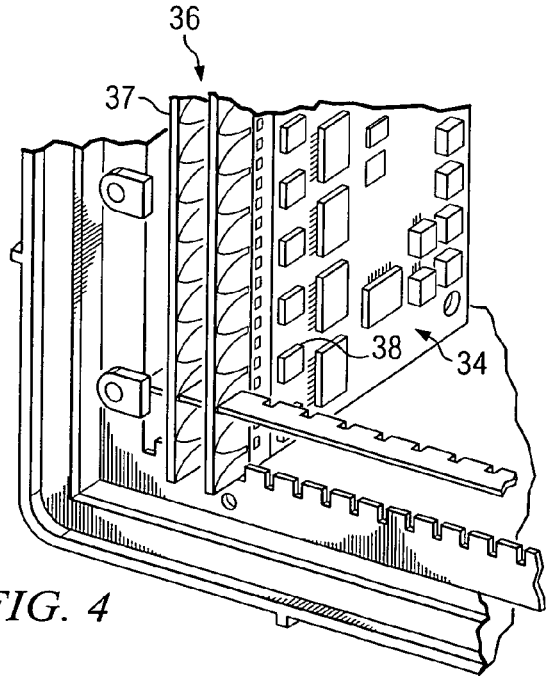

FIGS. 3 and 4 illustrates further details of an AESA unit 30, according to an embodiment of the invention. The AESA unit 30 of FIG. 3 has a portion of the radome cover 40 removed to reveal a portion of the electronic components 34 and an antenna array 36 within the AESA unit 30. The radome cover 40 covers a window 32 through which the antenna array 36 and electronic components 34 may electronically scan for individuals or objects.

The radome cover 40 may be designed with a two-fold purpose of being transparent to electromagnetic signals while maintaining a capability to dissipate kinetic energy of moving objects, namely bullets and fragmentation armaments. Further details of embodiments of the radome cover 40 will be described below.

FIG. 4 is an exploded view of the electronic components 34 and the antenna array 36 of FIG. 3. For purposes of illustration, the entirety of the antenna array 36 has not been shown. As will be recognized by one of ordinary skill in the art, antenna arrays 36 may utilize a plurality of elements that radiate signals with different phases to produce a beam via constructive/destructive interference. The direction the beam points is dependent upon differences of the phases of the elements and how the radiation of the elements constructively or destructively force the beam to point in a certain direction. Therefore, the beam can be steered to a desired direction by simply changing the phases of the elements. Using such steering, in particular embodiments the antenna array 36 may both transmit and receive signals.

In this embodiments, the radiating elements are shown as flared notched radiators 37. Although flared notch radiators 37 are shown in the embodiment of FIG. 4, other embodiments may utilize other typed of radiating elements, including but not limited to monopole radiators, other radiators, or combinations of the preceding.

The electronic components 34 in this embodiment include a Transmit Receive Integrated Microwave Module (TRIMM) assembly with a power amplifier monolithic microwave integrated circuits (P/A MMIC) 38. A variety of other components for electronic components 34 may additionally be utilized to facilitate an operation of the AESA unit 30, including but not limited, phase shifters for the flared notched radiators 36.

The components of the antenna array 36 and the electronic components 34 are only intended as showing one example of an RF technology. A variety of other RF technology configurations may avail themselves of the teachings of embodiments of the invention. Accordingly, the electronic components 34 or antenna array 36 may include more, less, or different components that those shown in FIGS. 3 and 4. Such components may include, but are not limited to, antennas, sensors (including single RF sensors), radiating devices, and others.

Figure 5A:
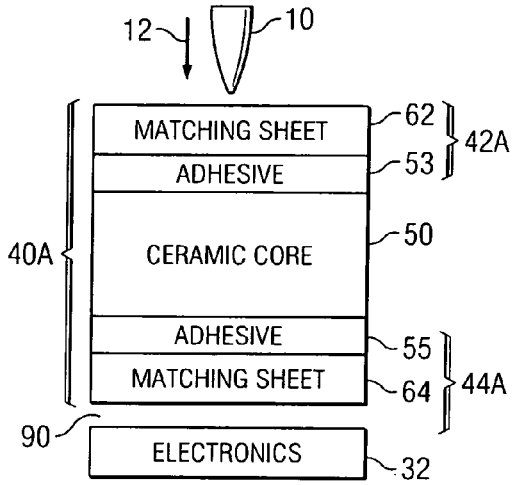
FIG. 5A shows a cross sectional view of a radome cover, according to an embodiment of the invention.

FIG. 5A shows a cross sectional view of a radome cover 40A, according to an embodiment of the invention. Disposed underneath the radome cover 40A beneath a deflection zone or air gap 90 is RF components or electronics 32, which may comprise any of a variety of RF components, including, but not limited to, electronic components 34 and antenna array 36 discussed above with reference to FIGS. 3 and 4. As referenced above, the RF components or electronics 32 may include more, fewer, or different components than those described herein. Any suitable configuration of RF sensor components may avail themselves of the embodiments described herein.

The radome cover 40A may protect the RF components or electronics 32 from being disturbed by a moving object. For example, the radome cover 40A may protect the electronics from a ballistic object 10 moving in the direction of arrow 12 by converting the kinetic energy of the ballistic object 10 into thermal energy. During protection of such electronics 32, electromagnetic radiated signals are allowed to propagate in both directions through the layers of the radome cover 40A to and from the electronics 32.

The radome cover 40A in the embodiment of FIG. 5A includes a core 50 sandwiched between matching layers 42A, 44A. "Layer" as utilized herein may refer to one or more materials. Accordingly, in particular embodiments, matching layer 42A and matching layer 44A may only have one material. In other embodiments, matching layer 42A and/or matching layer 44A may have more than one material. Further detail of matching layers 42A and 44A are described below.

In particular embodiments, the type of material and thickness of the core 50 may be selected according to a desired level of protection. The core 50 may be made of one or more than one type of material. In particular embodiments, the core 50 may be made of a ceramic composite containing alumina (also referred to as aluminum oxide). Ceramic composites, containing alumina, may comprise a variety of percentage of alumina including, but not limited to, 80% alumina up to 99.9% alumina. In particular embodiments, the core 50 may utilize a ballistic grade of ceramic containing higher percentages of alumina. Although the core 50 is made of alumina in the embodiment of FIG. 5A, in other embodiments the core may be made of other materials. In particular embodiments, a thicker alumina core 50 will provide more protection. The core 50 may be monolithic or tiled in construction. In the case of tiles, hexagonal tiles, for example, can be bonded in place to form a layer which better addresses multi-hit capability. Further details of tiling configurations are provided below with reference to FIG. 9.

Suitable thicknesses for the core 50 in this embodiment include thicknesses between 0.5 inches and 3.0 inches. In other embodiments, the thickness of the core 50 may be less than or equal to 0.5 inches and greater than or equal to 3.0 inches. In particular embodiments, the core 50 may additionally provide for a ultra-low permeation path of water vapor, thereby protecting non-hermetic components that may exist in the electronics 32.

The matching layers 42A, 44A are utilized to impedance match the radome cover 40A for optimum radio frequency (RF) propagation through the radome cover 40A. Such impedance matching optimizes the radome cover 40A to allow higher percentage of electromagnetic power to be transmitted through the radome cover 40A, thereby minimizing RF loss. The concept of impedance matching should become apparent to one of ordinary skill in the art. Impedance matching in the embodiment of FIG. 5A may be accomplished through selection of particular types and thickness of matching layers 42A, 44A. Selection of the type of and thickness of the matching layers 42A, 44A in particular embodiments may vary according to the properties of the core 50 and operating frequencies of the RF components or electronics 32. That is, the selection of the type and thickness of the matching layers 42A, 44A may be dependent on the selection of the type and thickness of the core 50. Any of variety of radome design tools may be used for such a selection.

In the embodiment of FIG. 5A, matching layer 42A includes adhesive 53 and RF matching sheet 62, and matching layer 44A includes adhesive 55 and RF matching sheet 64. Suitable materials for the RF matching sheets 62, 64 include, but are not limited to, synthetic fibers such as polyethylenes marketed as SPECTRA® fiber and under the SPECTRA SHIELD® family of products. The adhesives 53, 55 couples the RF matching sheets 62, 64 to the ceramic core 50. Any of a variety of adhesives may be utilized.

In particular embodiments, the core 50 may have a high dielectric constant, for example, greater than six ("6") whereas the RF matching sheets 62, 64 may have a low dielectric constant, for example, less than three ("3"). In embodiments in which the core 50 is alumina, the core may have a dielectric constant greater than nine ("9").

Figure 6A:
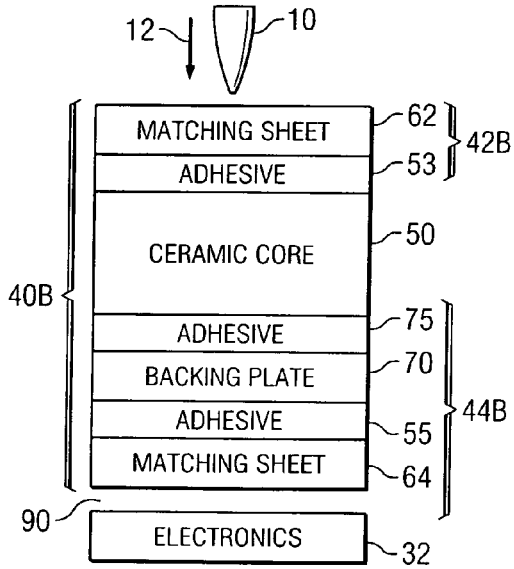
FIG. 6A shows a cross sectional view of a radome cover, according to another embodiment of the invention.

FIG. 6A shows a cross sectional view of a radome cover 40B, according to another embodiment of the invention. The radome cover 40B of FIG. 6A is similar to the radome cover 40A of FIG. 5A, including a core 50 sandwiched between matching layers 42B, 44B, except that the radome cover 40B of FIG. 6A additionally includes a backing plate 70 in matching layer 44B. Similar to that described above with reference to FIG. 5A, the matching layers 42B, 44B are utilized to impedance match the radome cover 40B for optimum radio frequency (RF) propagation through the radome cover 40B. Accordingly, the selection of the type of and thickness of the matching layers 42B, 44B in particular embodiments may vary according to the properties of the core 50 and operating frequencies of the RF components or electronics 32.

In particular embodiments, the backing plate 70 may provide structural stability (in the form of stiffness) to prevent the core 50 from going into tension, for example, when a size of the window 32 (shown in FIG. 3) increases. The backing plate 70 in particular embodiments may also serve as a "last catch" to prevent fragments from entering the RF components or electronics 32. Further, the backing plate 70 may act as a spall liner. Suitable materials for the backing plate 70 include, but are not limited to, ceramic materials marketed as NEXTEL™ material by 3M Corporation. An adhesive 75, similar or different than adhesives 53,55, may be utilized between the backing plate and the ceramic core 50. In particular embodiments, the backing plate 70 may have a dielectric constant between three ("3") and seven ("7").

Figure 7A:
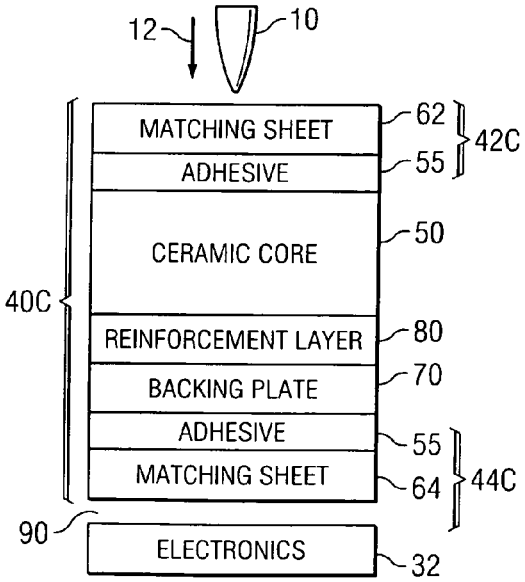
FIG. 7A shows a cross sectional view of a radome cover, according to another embodiment of the invention.

FIG. 7A shows a cross sectional view of a radome cover 40C, according to another embodiment of the invention. The radome cover 40C of FIG. 7A is similar to the radome cover 40B of FIG. 6A including a core 50 sandwiched between matching layers 42C, 44C, except that the radome cover 40C of FIG. 7A includes a reinforcement layer 80 in the matching layer 44C. Similar to that described above with reference to FIG. 5A, the matching layers 42C, 44C are utilized to impedance match the radome cover 40C for optimum radio frequency (RF) propagation through the radome cover 40B. Accordingly, the selection of the type of and thickness of the matching layers 42C, 44C in particular embodiments may vary according to the properties of the core 50 and operating frequencies of the RF components or electronics 32.

In particular embodiments, the reinforcement layer 80 may be made of rubber or other suitable material that provides additional dissipation or absorption of the kinetic energy. In particular embodiments, matching layer 42C may also include a reinforcement layer 80. In particular embodiments, the reinforcement layer 80 may have a dielectric constant between three ("3") and seven ("7").

Figure 5B:
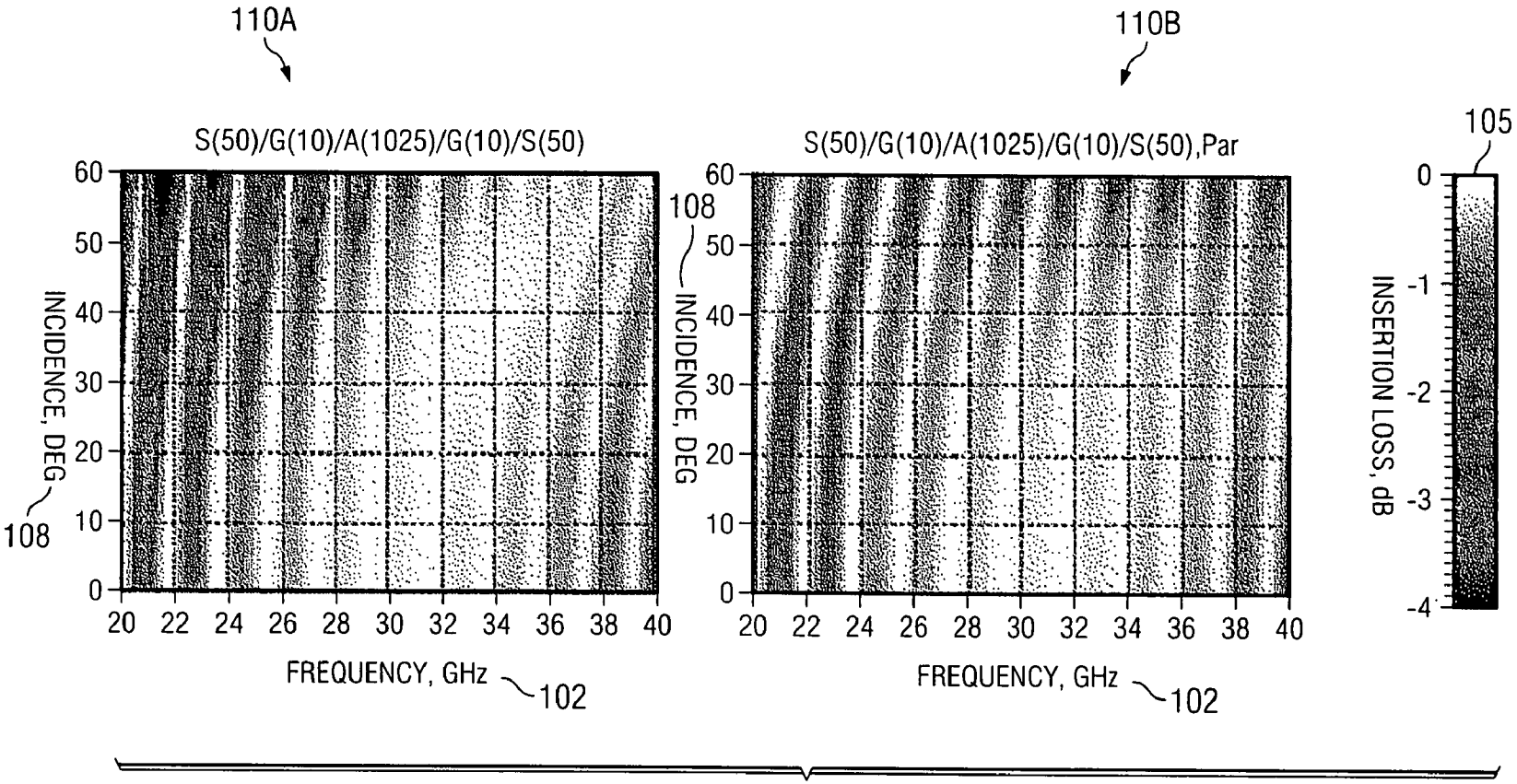
FIG. 5B shows graphs of predicted radome insertion loss corresponding to the radome cover of FIG. 5A.
Figure 6B:
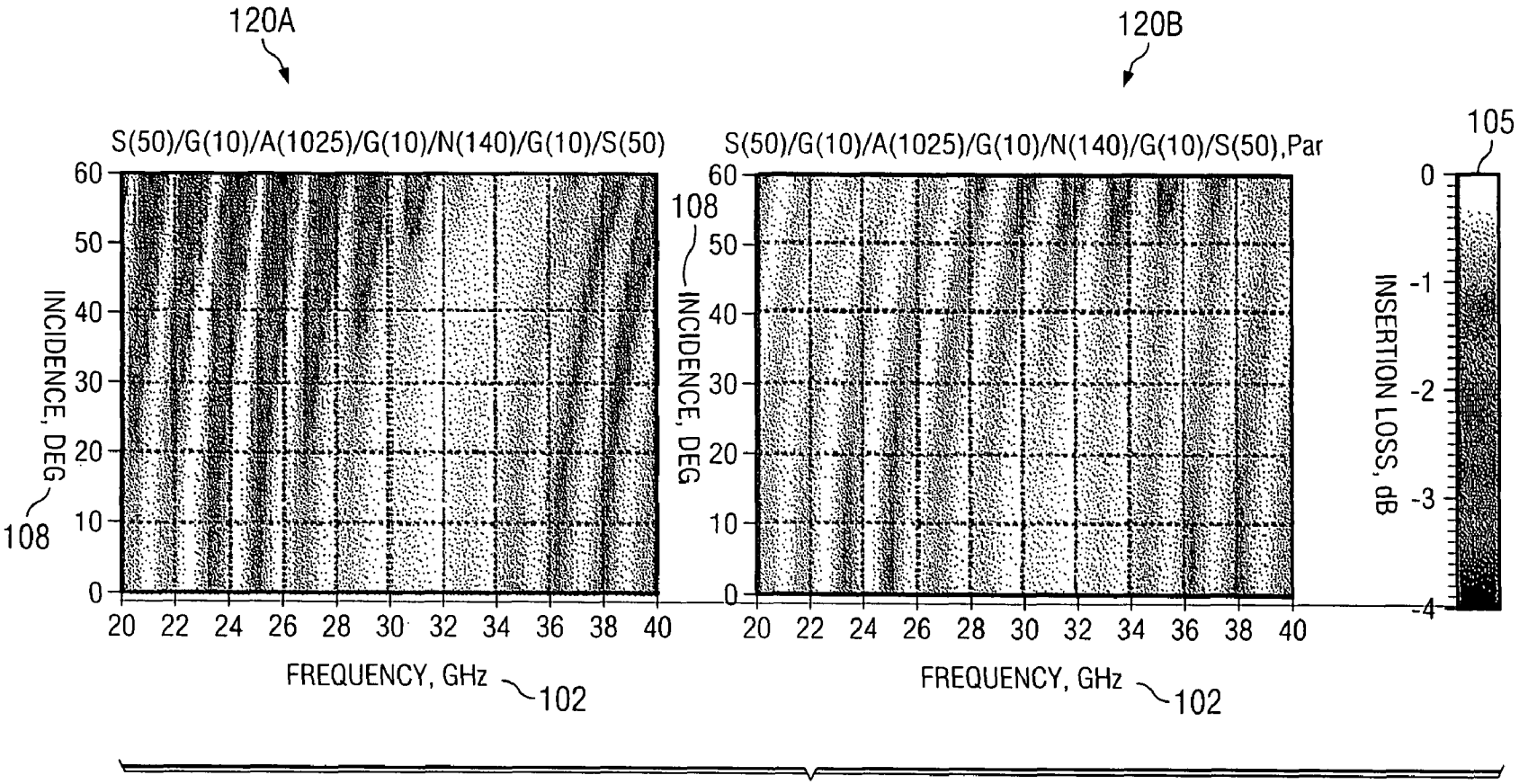
FIG. 6B shows graphs of predicted radome insertion loss corresponding to the radome cover of FIG. 6A.
Figure 7B:
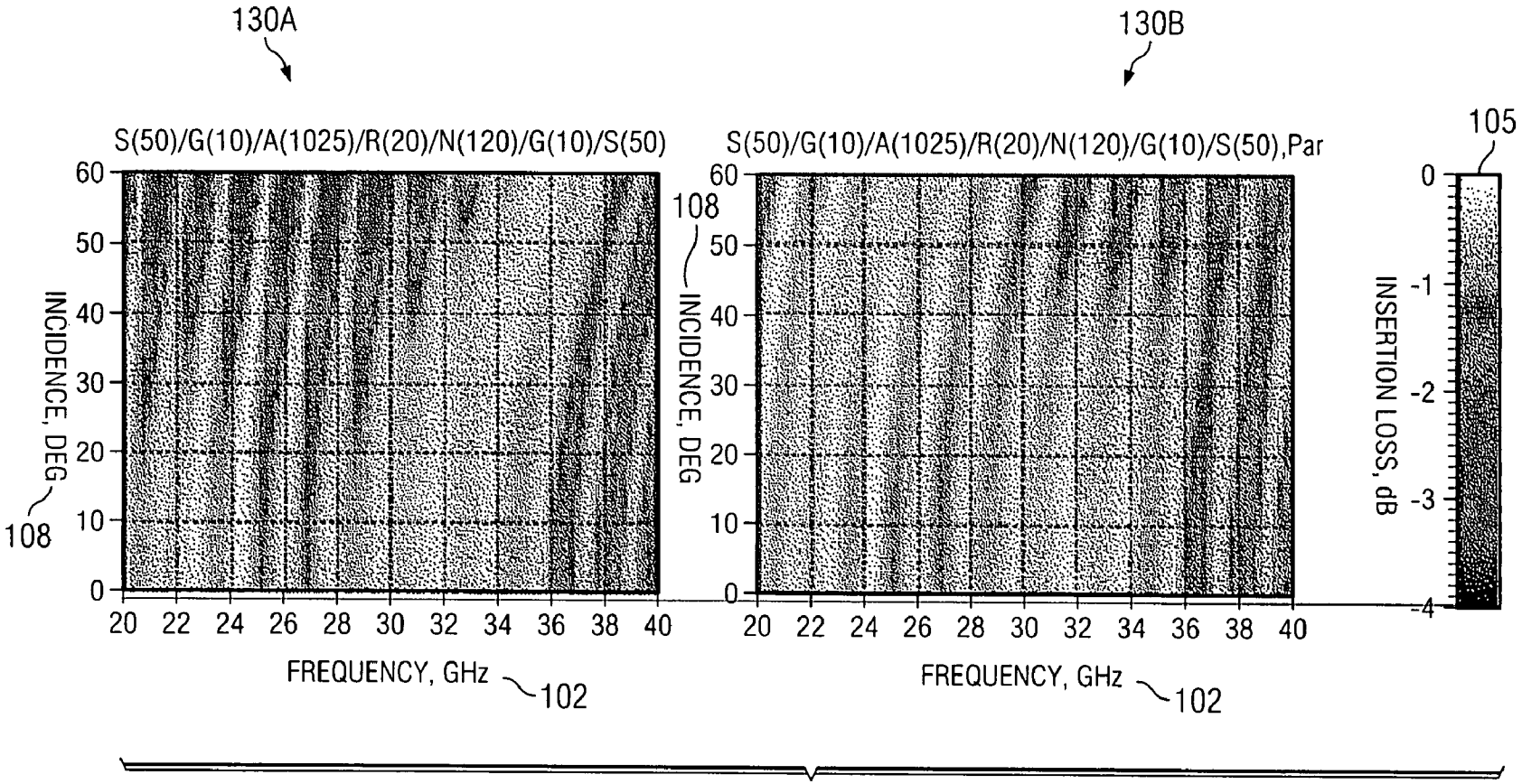
FIG. 7B shows graphs of predicted radome insertion loss corresponding to the radome cover of FIG. 7A.

FIGS. 5B, 6B, and 7B are graphs 110A, 110B, 120A, 120B, 130A, and 130B of predicted radome insertion losses respectively corresponding to radome covers 40A, 40B, and 40C of FIGS. 5A, 6A, and 7A. These graphs 110A, 110B, 120A, 120B, 130A, and 130B are intended as illustrating transmission loss performance (via modeling or experimentation) that can be taken for radome covers 40A, 40B, 40C. Although specific RF transmission loss performance for specific radome covers 40A, 40B, and 40C are shown in FIGS. 5B, 6B, and 7B, other RF performance can be taken for other radome covers 40, according to other embodiments. The graphs 110A, 110B of FIG. 5B are RF transmission loss performance corresponding to the following thicknesses for the radome cover 40A:

| Layer | Thickness (mils) |
|---|---|
| RF Matching Sheet (e.g., SPECTRA ®) | 50 |
| Adhesive | 10 |
| Ceramic Core (e.g., Alumina) | 1025 |
| Adhesive | 10 |
| RF Matching Sheet (e.g., SPECTRA ®) | 50 |

The graphs 120A, 120B of FIG. 6B are measurements corresponding to the following thicknesses for the radome cover 40B:

| Layer | Thickness (mils) |
|---|---|
| RF Matching Sheet (e.g., SPECTRA ®) | 50 |
| Adhesive | 10 |
| Ceramic Core (e.g., Alumina) | 1025 |
| Adhesive | 10 |
| Backing Plate (e.g., NEXTEL ™) | 140 |
| Adhesive | 10 |
| RF Matching Sheet (e.g., SPECTRA ®) | 50 |

The graphs 130A, 130B of FIG. 7B are RF transmission loss performance corresponding to the following thicknesses for the radome cover 40C:

| Layer | Thickness (mils) |
|---|---|
| RF Matching Sheet (e.g., SPECTRA ®) | 50 |
| Adhesive | 10 |
| Ceramic Core (e.g., Alumina) | 1025 |
| Reinforcement Layer(e.g., rubber) | 20 |
| Backing Plate (e.g., NEXTEL ™) | 120 |
| Adhesive | 10 |
| RF Matching Sheet (e.g., SPECTRA ®) | 50 |

Each of the graphs 110A, 110B, 120A, 120B, 130A, and 130B show by shading a RF transmission loss in decibels (dB) of transmitted energy through the radome covers 40A, 40B, and 40C over various frequencies 102 and incidence angles 108. The scale 105 indicates that a lighter color in the graphs 110A, 110B, 120A, 120B, 130A, and 130B represent a lower transmission loss. The incidence angles 108 are measured from boresight. Graphs 110A, 120A, and 130A are loss of the electric field perpendicular to the plane of incidence at incidence angles 108 from boresight while graphs 110B, 120B, and 130B are RF transmission loss of the electric field parallel or in the plane of incidence at incidence angles 108 from boresight. Using graphs 110A, 110B, 120A, 120B, 130A, and 130B, optimization can occur by selecting a particular frequency 102 for a particular desired incidence angle 108.

Figure 8:
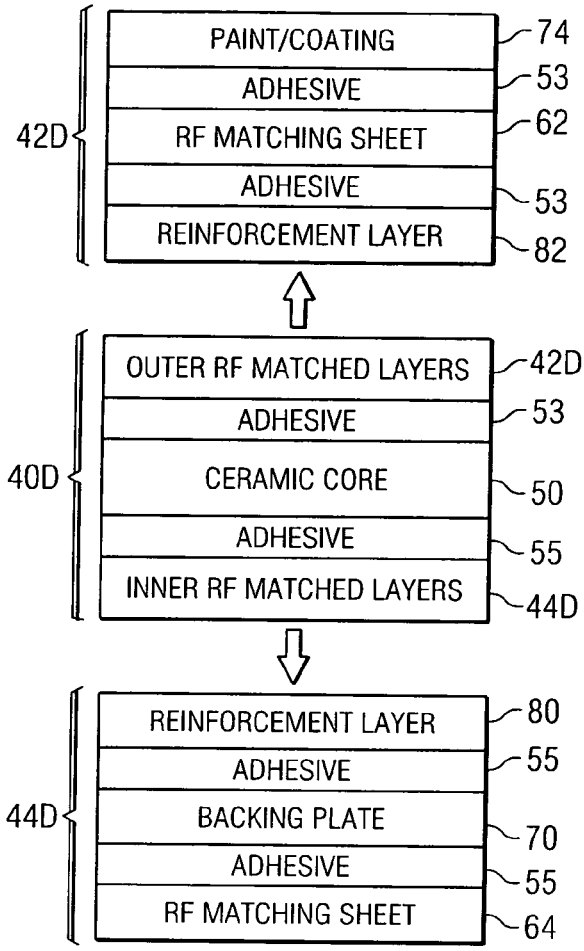
FIG. 8 is an illustration of variations of a radome cover, according to an embodiment of the invention.

FIG. 8 is an illustration of variations of a radome cover 40D according to an embodiment of the invention. The radome cover 40D of FIG. 8 may be similar to the radome cover 40A, 40B, and 40C of FIGS. 5A, 6A, and 7A, including a core 50 sandwiched between matching layers 42D and 44D. Similar to that described with reference to FIG. 5A, the matching layers 42B, 44B are utilized to impedance match the radome cover 40A for optimum radio frequency (RF) propagation through the radome cover 40A. Accordingly, the selection of the type of and thickness of the matching layers 42D, 44D in particular embodiments may vary according to the properties of the core 50 and operating frequencies of the electronics.

The radome cover 40D of FIG. 8 illustrates that the matching layers 42D, 44D may be made of any of a variety of materials. An example given in FIG. 8 is that matching layer 42D may be made of a paint/coating layer 74, a RF matching sheet 62, and a reinforcement layer 82 and that matching layer 44D may be made of a RF matching sheet 64, a backing plate 70 and a reinforcement layer 80. The RF matching sheets 62 and 64 were described above as were the backing plate 70 and reinforcement layer 80. The reinforcement layer 82 may be similar or different than the reinforcement layer 80. Paint/coating layer 74 may be made of any of variety of materials. Any of a variety of adhesives 53, 55 may additionally be utilized.

Figure 9:
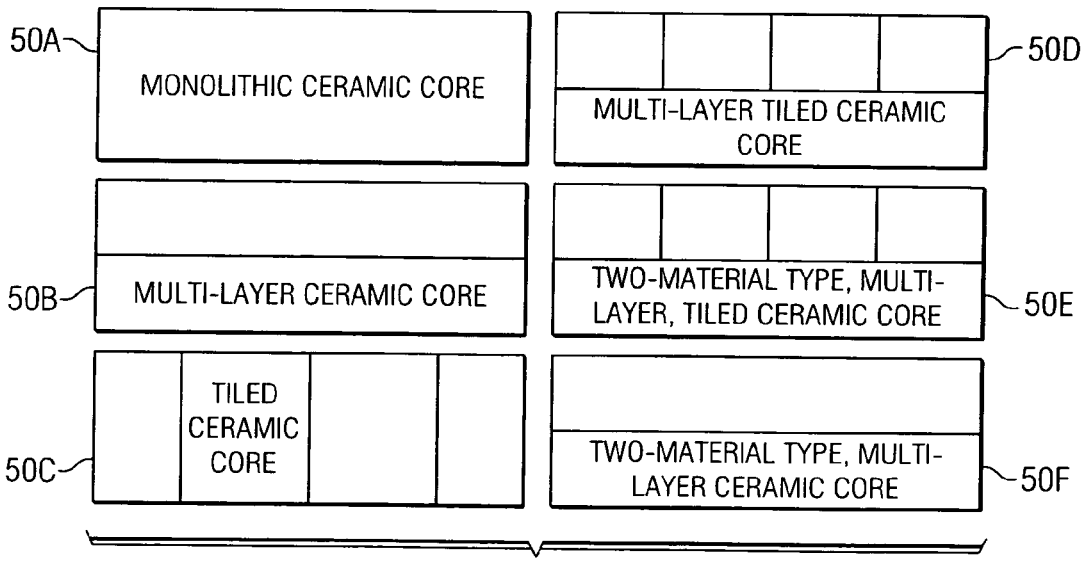
FIG. 9 is an illustration of configurations of a core, according to embodiments of the invention.

FIG. 9 is an illustration of configurations of a core 50, according to embodiments of the invention. As described with reference to FIG. 5A, the core 50 may be made of one or more than one type of material and the core 50 may be monolithic or tiled in construction. In the case of tiles, hexagonal tiles, for example, can be bonded in place to form a layer which better addresses multi-hit capability.

Core 50A shows a monolithic configuration. Core 50B shows a multi-layer, same material configuration. Core 50C shows a tiled, same material configuration. Core 50D shows a partially tiled, multi-layer, same material configuration. Core 50E shows a partially tiled, multi-layer, multi-material configuration. Core 50F shows a multi-layer, multi-material configuration. Other configuration will become apparent to one or ordinary skill in the art.

Although the present invention has been described with several embodiments, a myriad of changes, variations, alterations, transformations, and modifications may be suggested to one skilled in the art, and it is intended that the present invention encompass such changes, variations, alterations, transformation, and modifications as they fall within the scope of the appended claims.

What is claimed is:

1. A radio frequency assembly comprising:

a radome cover, comprising:

a core having a dielectric constant greater than six and having a thickness greater than or equal to 0.5 inches, the core propagating signals with a frequency greater than or equal to 20 GHz without substantial signal loss, the core consisting essentially of ceramic; and at least two layers, the core sandwiched between the at least two layers and the at least two layers impedance matched to the core for a frequency band; and at least one radio frequency component disposed beneath the radome cover.

2. The radio frequency assembly of claim 1, wherein each of the at least two layers has an average dielectric constant less than three.

3. The radio frequency assembly of claim 1, wherein the core has a dielectric constant greater than nine.

4. The radio frequency assembly of claim 1, wherein the at least two layers comprise polyethylene.

5. The radio frequency assembly of claim 1, wherein the core comprises alumina.

6. The radio frequency assembly of claim 5, wherein at least one of the at least two layers comprise:

a backing plate operable to provide structural support to the core.

7. The radome cover of claim 1, wherein the radome cover is operable to substantially dissipate kinetic energy from a bullet in a manner that protects the at least one radio frequency component.

8. The radio frequency assembly of claim 1, wherein the core propagating signals with a frequency greater than or equal to 20 GHz comprises the core propagating signals in the Ka frequency band without substantial signal loss.

9. The radio frequency assembly of claim 1, wherein the at least two layers is only two layers.

10. A radome cover comprising:

a core having a dielectric constant greater than six and having a thickness greater than or equal to 0.5 inches, the core propagating signals with a frequency greater than or equal to 20 GHz without substantial signal loss, the core consisting essentially of ceramic; and at least two layers, the core sandwiched between the at least two layers and the at least two layers impedance matched to the core over a frequency band.

11. The radome cover of claim 10, wherein the core comprises alumina;

the at least two layers comprise polyethylene; and each of the matching layers has an average dielectric constant less than three.

12. The radome cover of claim 10, wherein the core comprises alumina.

13. The radome cover of claim 10, wherein the at least two layers comprise polyethylene.

14. The radome cover of claim 10, wherein at least one of the at least two layers comprises:

a backing plate operable to provide structural support to the ceramic core.

15. The radome cover of claim 10, wherein the radome cover is operable to substantially dissipate kinetic energy from a bullet in a manner that protects at least one radio frequency component.

16. The radome cover of claim 10, wherein the core has a dielectric constant greater than six.

17. The radome cover of claim 16, wherein each of the at least two layers has an average dielectric constant less than three.

18. The radome cover of claim 16, wherein the core has a dielectric constant greater than nine.

19. The radome cover of claim 10, wherein the frequency band comprises the Ka frequency band.

20. The radome cover of claim 10, wherein the at least two layers is only two layers.

21. A method of creating a radome cover, the method comprising:

selecting a ceramic core consisting essentially of ceramic having a thickness greater than or equal to 0.5 inches and having a dielectric constant greater than six;

selecting at least two layers that are impedance matched to the ceramic core over a frequency band comprising a frequency greater than or equal to 20 GHz; and coupling the ceramic core between the at least two layers, the ceramic core propagating signals with a frequency greater than or equal to 20 GHz without substantial signal loss.

22. The method of claim 21, wherein the ceramic core comprises alumina, selecting the ceramic core comprises selecting a thickness of the ceramic core comprising alumina, the at least two layers comprise polyethylene; and selecting the at least two layers comprises selecting a thickness of each of the at least two layers.

23. The method of claim 21, wherein the at least two layers is only two layers.

* * * * *